US006382879B1

(12) United States Patent
Bullivant

(10) Patent No.: US 6,382,879 B1
(45) Date of Patent: May 7, 2002

(54) PILE AND METHOD THEREOF

(75) Inventor: Roger A. Bullivant, Burton on Trent (GB)

(73) Assignee: Global Innovations, LLC, Grand Prairie, TX (US)

( * ) Notice: Subject to any disclaimer, the term of this patent is extended or adjusted under 35 U.S.C. 154(b) by 0 days.

(21) Appl. No.: 09/503,130

(22) Filed: Feb. 11, 2000

(30) Foreign Application Priority Data

Feb. 11, 1999 (GB) ..... 9902992

(51) Int. Cl.[7] ..... E02D 5/30
(52) U.S. Cl. ..... 405/256; 405/254
(58) Field of Search ..... 405/256, 231, 405/254, 250, 251, 249, 252, 275, 278, 280, 281, 286

(56) References Cited

U.S. PATENT DOCUMENTS 1,988,492 A * 1/1935 Henderson
3,416,276 A * 12/1968 Caputo et al. ..... 52/606
4,524,551 A * 6/1985 Scheiwiller ..... 52/96
4,887,691 A * 12/1989 Rotondo ..... 181/210
5,417,523 A * 5/1995 Scales ..... 405/284
5,688,078 A * 11/1997 Hammer ..... 405/286
5,765,970 A * 6/1998 Fox ..... 405/284
6,089,792 A * 7/2000 Khamis ..... 405/262
6,152,655 A * 11/2000 Hull ..... 405/286

FOREIGN PATENT DOCUMENTS

DE 2756863 A1 * 12/1977

* cited by examiner

*Primary Examiner*—David Bagnell
*Assistant Examiner*—Katherine Mitchell
(74) *Attorney, Agent, or Firm*—Sidley Austin Brown & Wood LLP

(57) ABSTRACT

A pile for driving into the ground to provide support for a structure is elongate and is substantially rectangular in cross-section when viewed along its length. The ratio of the side lengths in cross-section may be 2:1 or greater, or may be 3:1 or greater. The pile is preferably formed of concrete and is preferably formed by extrusion. The pile preferably comprises at least one cavity running lengthwise along and within the pile, and preferably comprises at least one reinforcing bar running lengthwise along and within the pile. The arrangement of the cavities and/or reinforcing bars is preferably symmetrical about the central axis of the pile.

20 Claims, 3 Drawing Sheets

PILE AND METHOD THEREOF

FIELD OF THE INVENTION

The present invention relates to a pile for driving into the ground to provide support for a structure, such as a building.

BACKGROUND OF THE INVENTION

Various types of piles have previously been proposed for driving into the ground to support a new or existing structure such as a building, particularly when ground beneath the building is unstable or of poor quality and thus is less able to support the load of the structure. Previous proposals have certain disadvantages, at least for some applications.

SUMMARY OF THE INVENTION

The present invention provides a pile for driving into the ground to provide support for a structure, the pile being elongate and being substantially rectangular in cross-section when viewed along its length.

The ratio of the side lengths in cross-section may be 2:1 or greater, or may be 3:1 or greater. The longer sides of the rectangle may be at least 600 mm, with shorter sides of at least 68 mm, such as 150 mm or 225 mm. Alternatively, the longer sides may be approximately 300 mm in length, with shorter sides of length from 68 mm to 150 mm.

The pile is preferably formed of concrete. The pile is preferably formed by extrusion. The pile preferably comprises at least one cavity running lengthwise along and within the pile, and preferably comprises at least one reinforcing bar running lengthwise along and within the pile. The arrangement of the cavities and/or reinforcing bars is preferably symmetrical about the central axis of the pile.

Preferably at least one pair of opposed sides of the pile is formed with cooperating formations which mate with corresponding formations of another like pile when like piles are driven alongside each other. The cooperating formations are preferably substantially complementary in outline when viewed along the length of the pile. The cooperating formations may comprise a tongue and a complementary groove. The cooperating formations are preferably provided on the short sides of the rectangular section.

BRIEF DESCRIPTION OF THE DRAWINGS

Embodiments of the invention will now be described in more detail, by way of example only, and with reference to the accompanying drawings, in which.

DETAILED DESCRIPTION OF THE INVENTION

Figure 1:
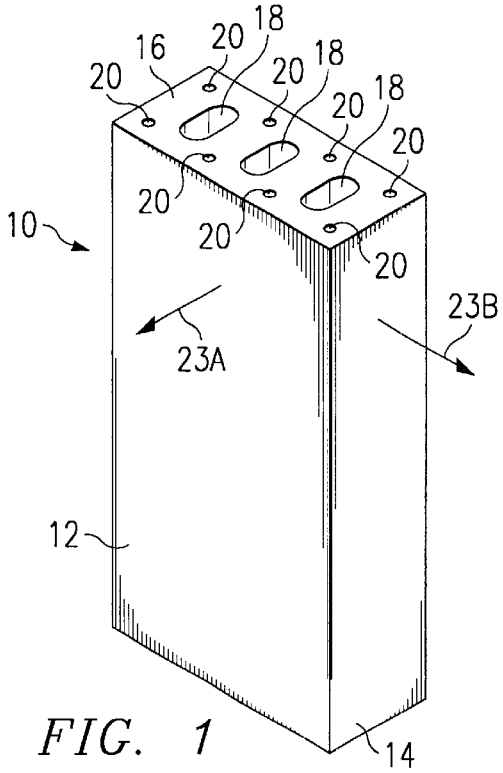
FIG. 1 is a perspective view of a first embodiment of the present invention.

FIG. 1 shows a pile 10 for driving into the ground to provide support for a structure, as will be described. The pile 10 elongate and is substantially rectangular in section (see FIG. 2) when viewed along its length.

Figure 2:
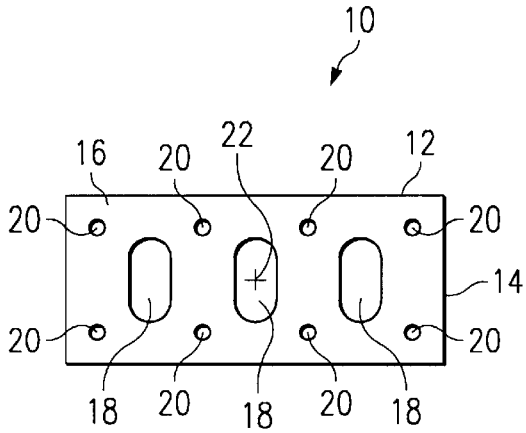
FIG. 2 is a top plan view of the pile of FIG. 1.

The pile section shown in FIG. 2 has long sides 12 and short sides 14. The body 16 of the pile is made of concrete, by extrusion, as will be described. The extrusion process forms cavities 18 within the body 16. In this example, three cavities 18 are formed, each being generally oval and equally spaced across the body 16.

The pile 10 also includes reinforcing bars (rebars) 20. In this example, eight rebars 20 are provided, arrayed in two lines of four. The arrangement provides a rebar 20 in each corner of the body 16, with four further rebars 20 being located at the long sides 12, between each adjacent pair of cavities 18.

It is apparent from FIG. 2 that the arrangement of rebars 20 and cavities 18 is symmetrical about the central axis 22 of the pile. Indeed, the arrangement in this example is symmetrical at the central plane parallel to the long sides 12, and also at the central plane parallel with the short sides 14. This arrangement provides enhanced performance for the pile, as described below.

The rectangular section of the pile 10 provides the pile with a directional performance. If a load is applied to the end of the pile 10, perpendicular to the long side 12, this results in a bending moment and the pile 10 will tend to deflect in the direction of the arrow 23A. In so doing, the pile 10 will present a relatively large face to the surrounding ground, by virtue of the length of the long side 12. The relatively narrow thickness of the pile 10 parallel with the moment (i.e. the relatively short length of the sides 14) will mean that the resistance to this moments primarily provided by the long side 12 bearing on the ground. Thus, while this resistance will be dependent on the quality of the ground, the relatively large surface area will help compensate for any inadequacy arising from poor ground quality.

By contrast, if a bending moment is applied to the pile perpendicular to the short sides 14, the pile will tend to deflect as indicated by the arrow 23B. The pile 10 is now relatively thick (by virtue of the relatively long length of the sides 12) and in addition, there are four lines of rebar 20 and three cavities 18 across this thickness (whereas deflection along the arrow 23A is resisted only by two lines of rebar 20 and one line of cavities 18). As a result, the pile 10 is expected to be very much stiffer when deflected in the direction of 23B than when deflected in the direction of 23A. If the ground is particularly poor, or particularly high resistance to bending moments is required in a particular application, the pile 10 can be installed in order to use this relatively high stiffness to resist the maximum expected bending moment.

The pile 10 can therefore be installed at an appropriate angle (by rotation about a vertical axis) to make best use of the two different performance parameters provided in the two perpendicular directions.

Figure 3:
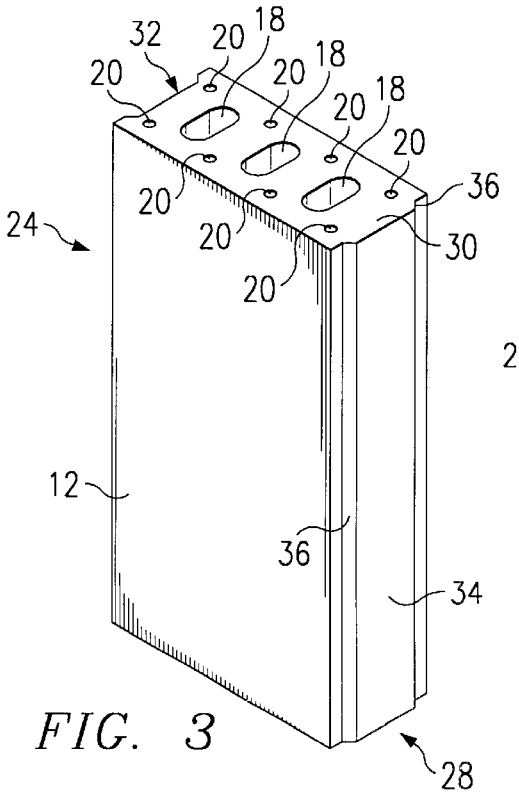
FIG. 3 is a perspective view of a second embodiment of the present invention.
Figure 4:
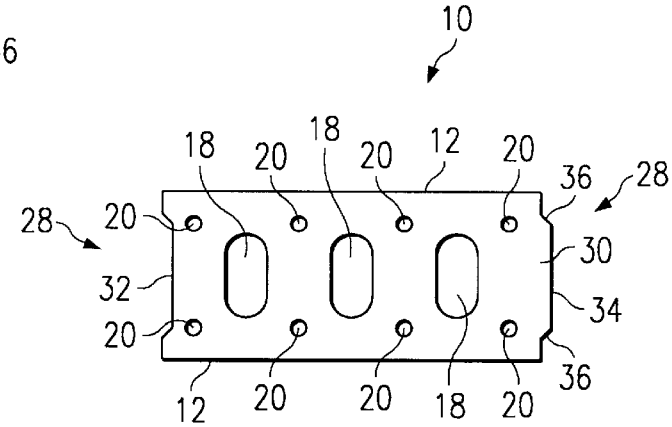
FIG. 4 is a top plan view of the pile of FIG. 3.

FIGS. 3 and 4 show an alternative embodiment. The pile 24 of FIG. 3 differs from the pile 10 only in its outline in section (FIG. 4). Other features correspond with those of the pile 10 and are given like reference numerals.

The pile section in FIG. 4 has long sides 12 and short sides 28 forming a generally rectangular section, but the short sides 28 form, respectively, a tongue 30 and groove 32. In this example, the tongue 30 has a flat face 34 and sloping walls 36. The groove 32 has bottom and side walls of shape complementary to that of the tongue. The section of FIG. 4 is continued along the whole length of the pile 24, which is readily achieved by extrusion.

Figure 5:
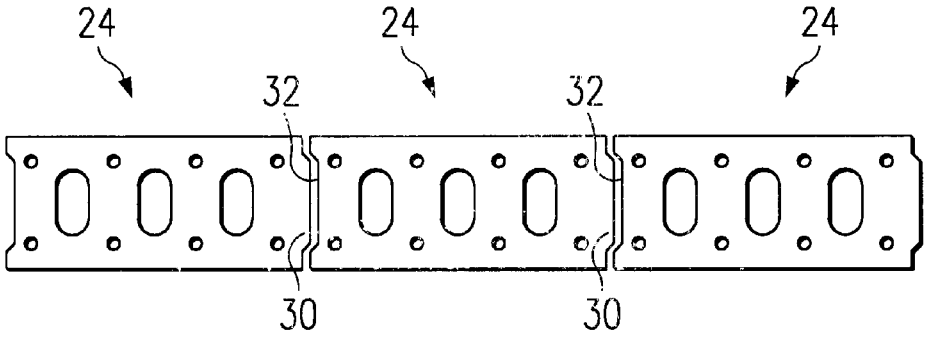
FIG. 5 is a plan view of three piles as shown in FIG. 3, installed side-by-side.

FIG. 5 shows three piles 24 installed side-by-side, by driving into the ground. It is readily apparent that the complementary shapes of the tongues 34 and grooves 32 allow the short sides 28 of adjacent piles 24 to mate, thus closing any gaps between adjacent piles 24 and providing substantially continuous inner and outer surfaces provided by the long sides 12. This allows the piles 24 to be used for a dual purpose. First, they can be driven to provide support as a pile, but by providing a substantially continuous wall, they can also act as a shuttering, basement wall or the like. In addition, piles 24 can be used individually and will display the directional performance described above, but the tongue 30 and groove 32 are then not relevant.

Figure 6:
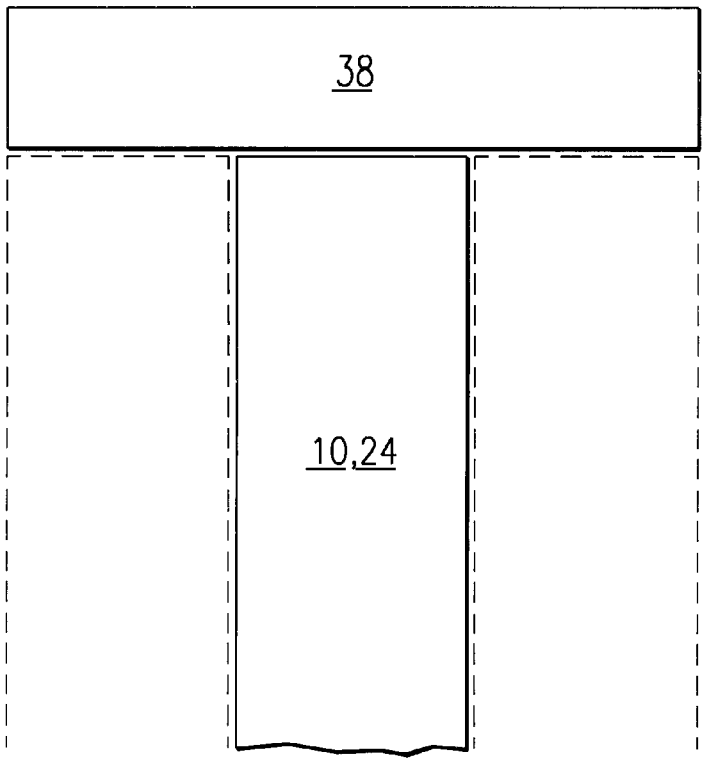
FIG. 6 is a schematic side elevational view showing the use of piles according to the present invention to support a structure.

FIG. 6 illustrates schematically the manner of use of the pile 10,24. In FIG. 6 a load 38 is to be supported, and may be a building, building foundation or other load. A pile 10,24 is driven substantially vertically into the ground to provide a support on which the load 38 may be rested. The load 38 may be a simple load which applies only a vertical loading to the pile 10,24, or may be a more complex load (such as a building wall) which applies a load which is not vertical, and thus applies a bending moment to the pile 10,24. The pile 10,24 will therefore be installed at an appropriate angle to accommodate this load, as indicated above. Additional piles 10,24 may be installed, the piles either being alongside each other as indicated by broken lines in FIG. 6, or spaced from each other. Piles 24 may be mated as illustrated in FIG. 5, or may be spaced apart. Piles 10 (FIGS. 1 and 2) may be abutted or may be spaced apart.

The piles may be inserted into the ground by any appropriate driving technique.

Figure 7:
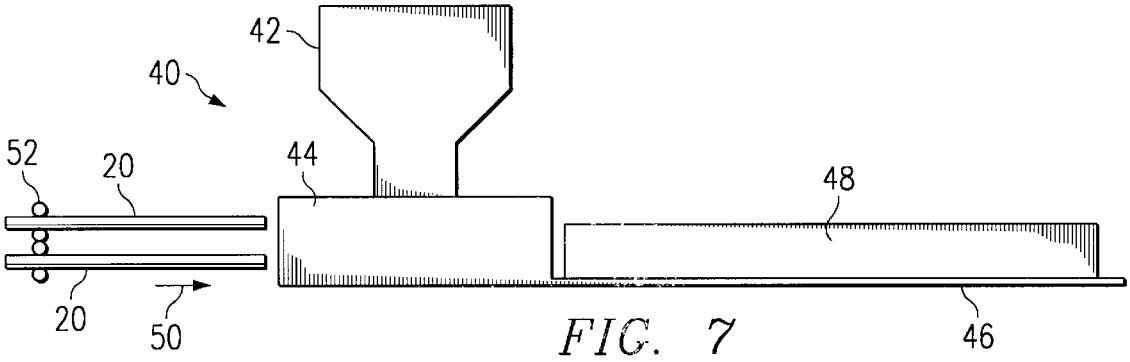
FIG. 7 is a schematic side elevational view of an extrusion machine for use in forming piles according to the present invention.
Figure 8:
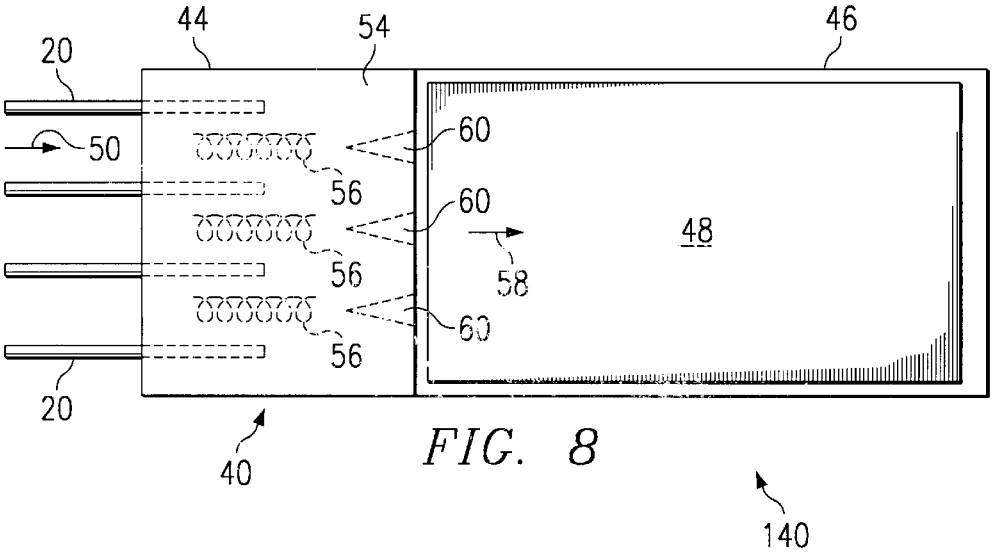
FIG. 8 is a partial schematic plan view of the extrusion machine of FIG. 7.
Figure 9:
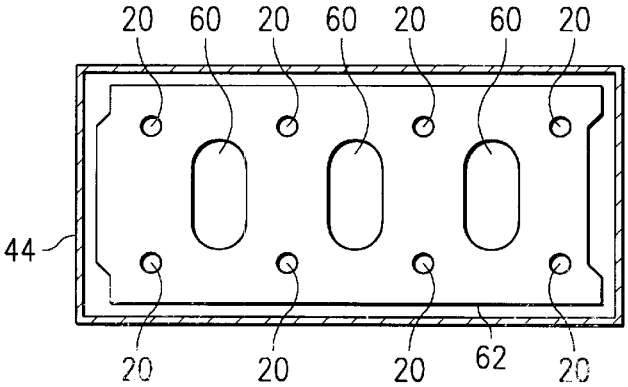
FIG. 9 is a schematic end elevational view of the extrusion head of the machine of FIG. 7.

The piles 10,24 can be manufactured by an extrusion apparatus as illustrated schematically in FIGS. 7 to 9. The extrusion apparatus 40 includes a hopper 42 for concrete to be extruded, an extrusion head 44 to which concrete is fed from the hopper 42 by gravity, and a drying bed 46 to receive extruded piles, one of which is indicated at 48. Rebar 20 is fed into the extrusion head 44 to pass horizontally through the extrusion head 44 in the direction of the arrow 50, by rollers 52.

FIG. 8 illustrates schematically the arrangement within the extrusion head 44. The extrusion head 44 has an internal space 54 into which concrete falls from the hopper 42. A series of rotating screw augers 56 rotate within the internal space 54 to drive the concrete out of the extrusion head 44 in the direction of the arrow 58, to the drying bed 46. In so doing, the concrete must pass around mandrels 60 which define the cavities 18 in the finished article. In addition, the rollers 52 drive the rebar 20 into the concrete at appropriate positions relative to the mandrels 60 to provide the rebar distribution illustrated and described above. It will be apparent that the operation can be executed substantially continuously, with concrete feeding continuously from the hopper 42 and being continuously extruded past the mandrels 60 by the rotating screw augers 56. Rebar 20 is continuously introduced by the rollers 52. In principle, piles of any length can therefore be produced. In practice, it may be desirable to use rebar cut to length, and to guillotine the extruded article to a required length.

FIG. 9 illustrates the extrusion nozzle of the extrusion head 44, showing the mandrels 60, the overall outline 62 of the resultant extruded pile, and the rebar 20 (in section) being fed through the extrusion head 44, into the pile.

It is envisaged that the piles 10, 24 may have dimensions of 600 mm by 200 mm, or 600 mm by 300 mm, giving side lengths in the ratios of 3:1 or 2:1 (i.e., the dimension of side 12 shown in FIG. 2 to the dimension of side 14 shown in FIG. 2). It will be readily apparent that many other sizes could be chosen and that, in particular, the chosen ratio will affect the degree of directional variation in performance. In order for this to be significant in practice, it is expected that a length ratio of at least 2:1 would be required. When an extrusion nozzle of 600 mm width is used, it is envisaged that the nozzle could be closed to give a nozzle height, which produces the side length of side 14, from as little as 68 mm up to 300 mm, with 150 mm and 225 mm being preferred. Alternatively, the width could be divided into two openings of width 300 mm, to produce two piles side-by-side, again with thicknesses from 68 mm, up to about 150 mm, with 100 mm being preferred.

Many different pile lengths could be used, with pile lengths of between 2 m and 6 m being useful for many practical circumstances. The number, choice and layout of cavities and rebars can be varied according to the performance requirements, and indeed, it may not be necessary to provide rebar or cavities in all circumstances.

Whilst endeavoring in the foregoing specification to draw attention to those features of the invention believed to be of particular importance, it should be understood that the Applicant claims protection in respect of any patentable feature or combination of features hereinbefore referred to and/or shown in the drawings, whether or not particular emphasis has been placed thereon.

What is claimed is:

1. A pile comprising:

a body having a length parallel to its longitudinal axis and a plurality of longitudinally extending sides, said body having a generally rectangular outer cross-sectional shape in a plane perpendicular to said longitudinal axis of said body, said length being greater than a first side length and a second side length of said rectangular outer cross-sectional shape; and at least one longitudinally extending cavity disposed within said body, said at least one longitudinally extending cavity having a length which is substantially equivalent to said length of said body.

2. A pile according to claim 1, wherein said at least one longitudinally extending cavity has a generally oval cross-sectional shape in a plane perpendicular to said longitudinal axis of said body.

3. A pile according to claim 1, further comprising at least one longitudinally extending reinforcing bar disposed within said body.

4. A pile according to claim 3, wherein said at least one longitudinally extending reinforcing bar has a length which is substantially equivalent to said length of said body.

5. A pile according to claim 3, comprising:

a plurality of longitudinally extending cavities disposed within said body, each of said plurality of longitudinally extending cavities having a length which is substantially equivalent to said length of said body; and a plurality of longitudinally extending reinforcing bars disposed within said body.

6. A pile according to claim 5, wherein said plurality of longitudinally extending cavities and said plurality of longitudinally extending reinforcing bars are arranged to be symmetrical, in a plane perpendicular to said longitudinal axis of said body, about a central axis of said body.

7. A pile according to claim 1, wherein a side length ratio of said generally rectangular outer cross-sectional shape of said body is at least 2:1.

8. A pile according to claim 1, wherein a side length ratio of said generally rectangular outer cross-sectional shape of said body is at least 3:1.

9. A pile according to claim 1, wherein said body comprises a concrete portion.

10. A pile according to claim 1, said generally rectangular outer cross-sectional shape of said body having a pair of longer sides and a pair of shorter sides, said shorter sides comprising cooperating formations for mating with corresponding formations of adjacent piles.

11. A pile according to claim 10, wherein said cooperating formations comprise a tongue and a groove.

12. A pile comprising:

a body having a length parallel to its longitudinal axis and a plurality of longitudinally extending sides, said body having a generally rectangular outer cross-sectional shape in a plane perpendicular to said longitudinal axis of said body, said length being greater than a first side length and a second side length of said rectangular outer cross-sectional shape;

at least one longitudinally extending cavity disposed within said body, said at least one longitudinally extending cavity having a length which is substantially equivalent to said length of said body, wherein a cross-sectional shape of said cavity is generally oval in a plane perpendicular to said longitudinal axis of said body; and at least one longitudinally extending reinforcing bar disposed within said body, said at least one longitudinally extending reinforcing bar having a length which is substantially equivalent to said length of said body, wherein a side length ratio of said generally rectangular outer cross-sectional shape of said body is at least 2:1.

13. A pile according to claim 12, wherein said side length ratio is at least 3:1.

14. A pile according to claim 12, comprising:

a plurality of longitudinally extending cavities disposed within said body, each of said plurality of longitudinally extending cavities having a length which is substantially equivalent to said length of said body; and a plurality of longitudinally extending reinforcing bars disposed within said body.

15. A pile according to claim 14, wherein said plurality of longitudinally extending cavities and said plurality of longitudinally extending reinforcing bars are arranged in a symmetrical relationship to a central axis of said body in a plane perpendicular to said longitudinal axis of said body.

16. A pile according to claim 12, said generally rectangular outer cross-sectional shape of said body having a pair of longer sides and a pair of shorter sides, said shorter sides comprising cooperating formations for mating with corresponding formations of adjacent piles.

17. A pile according to claim 12, wherein said cooperating formations comprise a tongue and a groove.

18. A piling assembly comprising a plurality of piles, wherein:

each of said plurality of piles has a generally rectangular outer cross-sectional shape in a plane perpendicular to its longitudinal axis and each of said plurality of piles has a length being greater than a first side length and a second side length of said rectangular outer cross-sectional shape;

each of said plurality of piles has at least one longitudinally extending cavity disposed therein, said at least one longitudinally extending cavity having a length which is substantially equivalent to said length of said each of said plurality of piles;

said generally rectangular outer cross-sectional shape of said each of said plurality of piles has a pair of longer sides and a pair of shorter sides, said shorter sides comprising cooperating formations for mating with corresponding formations of adjacent piles of said plurality of piles.

19. A piling assembly according to claim 18, wherein said cooperating formations comprise a tongue and a groove.

20. A method of constructing a pile, comprising the steps of:

providing a quantity of prepared, unset concrete;

providing an extrusion form for forming said concrete;

providing at least one reinforcing bar of a predetermined length;

feeding said concrete through said extrusion form to produce a pile having a generally rectangular outer cross-sectional shape in a plane perpendicular to its longitudinal axis, said pile having at least one longitudinally extending cavity disposed therein, said at least one longitudinally extending cavity having a length which is substantially equivalent to a length of said pile; and feeding said at least one reinforcing bar into said concrete as said concrete is being fed through said extrusion form so that a longitudinal axis of said at least one reinforcing bar is generally parallel to said longitudinal axis of said pile.

* * * * *